United States Patent [19]

Warjone et al.

[11] 3,938,293

[45] Feb. 17, 1976

[54] POLE REINFORCEMENT INSTALLATION

[75] Inventors: James E. Warjone, Seattle, Wash.; Albert C. Wilkison, New Westminster, Canada

[73] Assignee: Truckweld Equipment Company, Seattle, Wash.

[22] Filed: June 28, 1974

[21] Appl. No.: 483,944

Related U.S. Application Data

[62] Division of Ser. No. 249,249, May 1, 1972, Pat. No. 3,847,231.

[52] U.S. Cl. ..... 52/742; 52/170; 61/54

[51] Int. Cl.[2] ..... E02D 7/06

[58] Field of Search ..... 52/170, 742; 61/53.5, 53.7, 61/54; 173/1, 43, 46, 126

[56] References Cited

UNITED STATES PATENTS

| | | | |
|---|---|---|---|
| 1,836,140 | 12/1931 | Upson | 61/53.7 |
| 3,320,714 | 5/1967 | Barrett | 52/742 |
| 3,499,497 | 3/1970 | Moore | 61/53.5 X |
| 3,527,310 | 9/1970 | Webber et al. | 173/43 |
| 3,738,072 | 6/1973 | Adrian | 52/170 |
| 3,771,610 | 11/1973 | Leyrat | 173/46 |

*Primary Examiner*—Paul R. Gilliam
*Assistant Examiner*—David H. Corbin
*Attorney, Agent, or Firm*—Seed, Berry, Vernon & Baynham

[57] ABSTRACT

Apparatus for installing a splint adjacent a vertically standing power pole or the like including a boom and driving mechanism for lifting the metallic splint and placing it in proper position and then driving same to the proper depth. The driving mechanism is self contained and need only be supported in driving position and provided with a source of momentum to drive the splint. The driving mechanism includes a hammer or anvil having a depending tongue which serves to support the splint during movement of the splint from the supply to the position adjacent the pole. The tongue also serves as a guide for the hammering means assuring proper driving contact with the splint during the driving process. The driving mechanism will be supported at the outboard end of the boom which may be held in a relatively rigid position by an adjustable deadleg which is pivotally secured to the outboard end of the boom or alternatively may be held rigid by securement to the pole.

4 Claims, 14 Drawing Figures

POLE REINFORCEMENT INSTALLATION

This is a division of application Ser. No. 249,249, filed May 1, 1972, now U.S. Pat. No. 3,847,231.

BACKGROUND OF THE INVENTION

The majority of currently used poles, such as for power or telephone, are wooden poles which have been treated to retard rotting and the like. In spite of the efforts to retard the rotting these poles are, after a short life span, weakened by rotting and erosion, normally at the ground level.

It has been the practice in the past to set a wooden stub along the side of the pole to be reinforced and bind the stub to the weakened pole thus lending the strength of the stub to the pole. This method of pole reinforcement is not only unsightly but further requires an excavation for setting the stub. The necessity of excavation prior to setting the stub involves considerable cost and inconvenience.

Efforts have been made to reinforce poles with the use of metallic stubs, which are less bulky in cross sectional area than the wooden stubs and which are not as unsightly. In the main, however, most metallic stubs have been of structural steel such as an I-beam and although these stubs are easy to drive they are not structurally suited for pole reinforcement. The point contact of the aforementioned stubs or splints tends to cause a loosening of the attachment band due to their gradually becoming more embedded in the pole due to the relative movement under cyclic loading.

To improve upon the splinting of wooden poles, metallic stubs have been designed having a small cross-sectional area to permit easy driving into the ground and have been shaped to provide a pair of spaced apart pole engagement surfaces which either are shaped complementarily to the curvature or engage tangentially with the poles. These configurations reduce the formation of water retaining pockets and the like which tend to result in the rotting of the pole. While the new splints have many advantages, as noted above, one of the problems with the contoured splint has been in the driving of the splint down immediately adjacent the pole. For the greatest utilization of the splint, contact should be along the entire length of the splint. When placing the splint it must be located adjacent the pole and maintained in a contiguous placement during the insertion period.

It is an object of this invention to provide an apparatus for quickly and easily placing and driving splints adjacent vertical wooden poles which are partially buried in the ground.

It is another object of the present invention to provide a driving mechanism for accurately and rapidly driving a splint adjacent a vertical pole including means assuring proper contact between the driving means and the splint resulting in a splint contiguous with the pole the entire length of the splint.

It is yet another object of the present invention to provide a splint driving mechanism which also serves as a stabilizing and placing means for locating the splint adjacent the pole to be reinforced.

It is still another object to provide a stabilizing and bracing element for use in conjunction with a boom when driving the splint adjacent a pole.

It is yet another object of the present invention to provide a tool for driving splints adjacent a vertical pole which includes as an integral part thereof a contoured means for close placement with the pole and further a depending guiding means for insertion in the splint during the driving assuring that the driving tool contacts the splint vertically.

A further object of the present invention is to provide a driving mechanism which is capable of driving splints for wooden poles, pipes or rods, and further, is relatively portable enabling the mechanism to be easily transported to the locus of the desired drive.

It is another object to provide a method for efficiently and sefely handling splints from a supply to a location adjacent a pole.

DETAILED DESCRIPTION OF THE DRAWINGS

Figure 1:
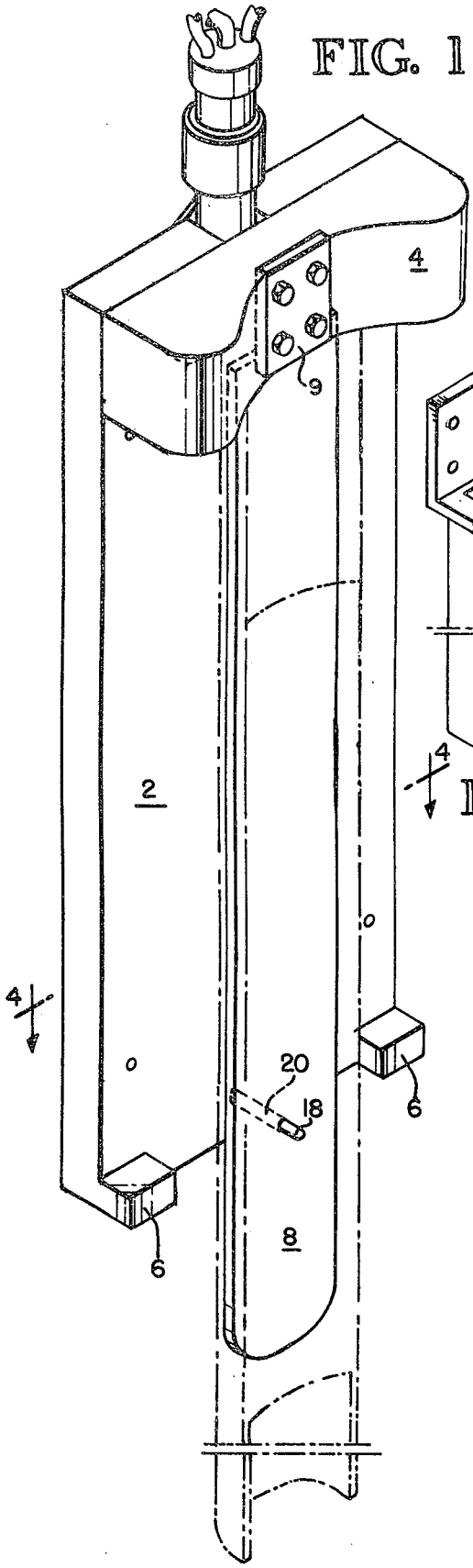
FIG. 1 is a perspective view of the driving tool as seen from the side which would be in contact with the pole to be reinforced, and with the splint driving attachment in position.

As can be seen in FIG. 1 the splint driving head comprises a heavy, solid generally rectangular main body portion 2 having at its upper end an outwardly projecting hammer head or anvil 4 and at its lower end a pair of outwardly protruding protective members 6. Because of the relative length of the tongue 8 with respect to the other dimensions of the head and because of its location, it is subject to damage and the members 6 provide support for the driving head when not in use, relieving the tongue from undue strain.

Tongue 8, as explained in greater detail hereafter, serves only as a guide and is removably secured by a bracket 9 to the hammer head or anvil 4 so it presents a smooth driving surface. The tongue is removable to allow the substitution of various sized tongues guiding other types of objects and different size splints.

Figure 2:
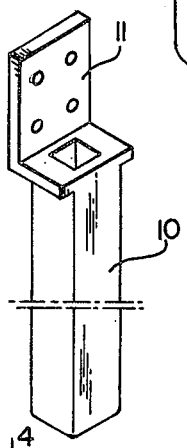
FIG. 2 is a perspective view of the attachment which is used in conjunction with driving a pipe or rod.

As seen in FIG. 2, the tongue 8 may be replaced with a guide 10 of square cross section having a bracket 11 which is secured in the same manner as bracket 9.

Both in the case of tongue 8 and guide 10, the element being driven contacts the hammer head or anvil 4 directly and so places no strain upon the supporting bracket.

Mounted within the main body portion 2 is a fluid ram or other conventional cylinder-rod apparatus 12 having an eye 13 secured to the end of its piston rod. A fluid connection 14 allows introduction of fluid into the interior of the ram or cylinder above the piston rod 12, and as will be explained in greater detail hereinafter, raises the cylinder relative to the rod to cause the entire driving tool to be raised.

The fluid conduit 14 is of sufficient internal diameter that once the valve (not shown in this figure) is open to the sump, the weight of the tool causes rapid evacuation without significantly impeding the free fall or reducing the inertia.

Mounted to the rear of the driving tool is a carrying hook 16 which, as will be explained in greater detail with respect to FIGS. 6 and 9 – 12, is used for supporting the splint as it is moved from the truck to the proper position for placement of the splint or stub.

Figure 3:
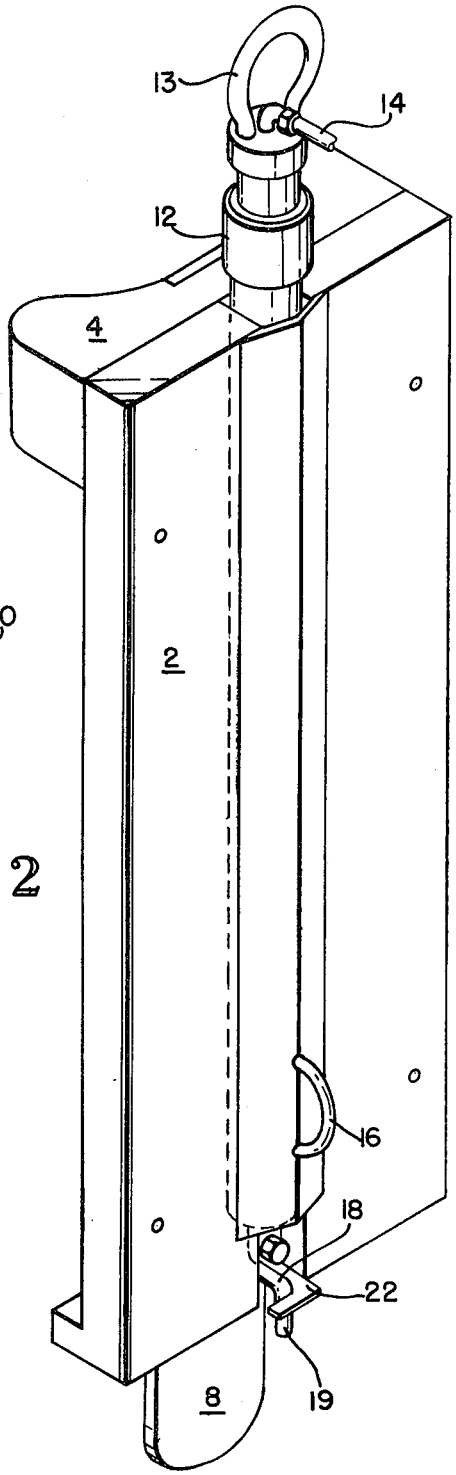
FIG. 3 is an isometric view of the splint driving tool from the opposite side as shown in FIG. 1 showing the location of the ram.

A latch member 18 extends through the main body portion 2 of the driving tool and is seated in a bore 20 in the tongue 8. When the latch member 18 is in the position as shown in FIG. 3, it extends through a splint and serves to lock it in place between the body of the driving tool and the tongue 8 for transport to the position adjacent the pole. As will be noted in FIG. 3, latch 18 may be locked in the inner, or splint supporting, position by turning the latch so that it is captured, since its handle 19 projects behind L-shaped bracket 22.

Figure 4:
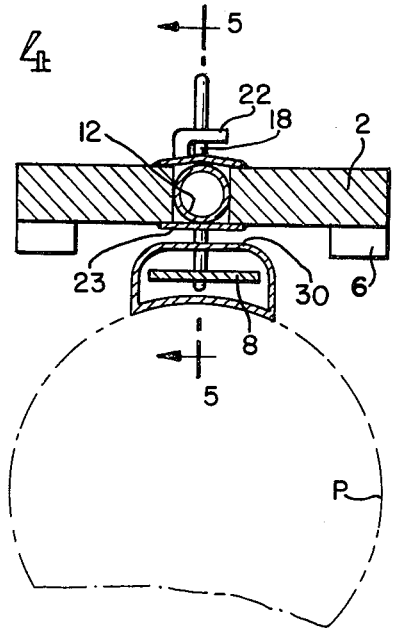
FIG. 4 is a sectional view along lines 4—4 of FIG. 1 with a splint in position for driving adjacent a pole.
Figure 5:
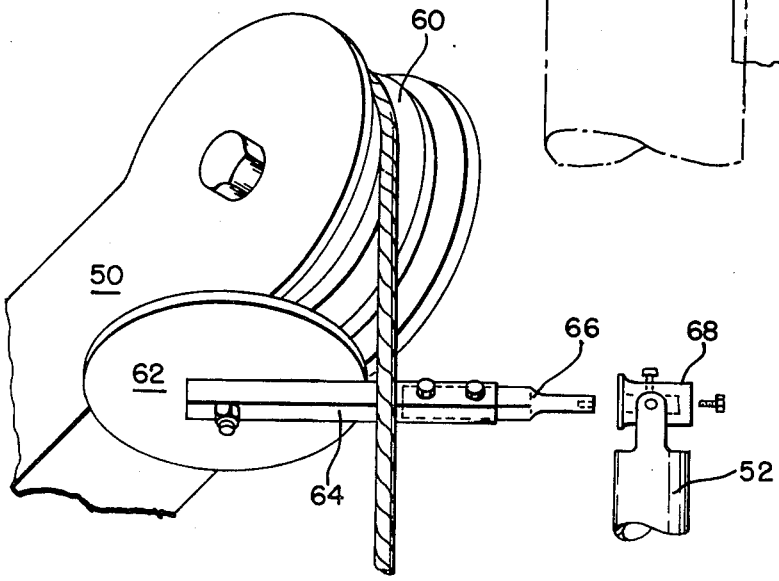
FIG. 5 is a partial vertical sectional view showing the relationship of the elements of the splint driving tool when in driving position adjacent the pole.

As seen in FIGS. 4 and 5, the splint 30, when being driven, is in a position adjacent the pole and has its back against the plate 23 which overlies and shields the cylinder 12 and has the tongue 8 extending to its hollow interior. When the splint is in position for driving the pin 18 and is moved to the position shown in phantom where it is outside the plane of the back of the splint 30 it will allow the splint to be contacted by the hammer and thus driven into the ground.

Although the description has been directed mainly to the driving of a splint, it is to be introduced that essentially the same procedure would be used to drive a pipe or rod. The pipe or rod would extend through the guide and directly contact the hammer or anvil 4 during the driving process.

Figure 6:
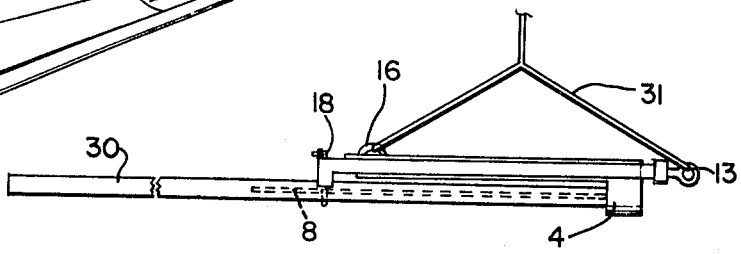
FIG. 6 is a view depicting the means for using the driving tool to transfer the splint to the proper position.

Referring now to FIG. 6, it can be seen that the splint or stub 30 is transported to the driving position by being locked to the driving tool. A sling 31 permits the splint or stub 30 to be picked up by the derrick winch, the sling secured to eye 13 and loop 16. The splint or stub 30 is captured between the tongue 8, the hammer head 4 and is held in position by latch 18.

Figure 7:
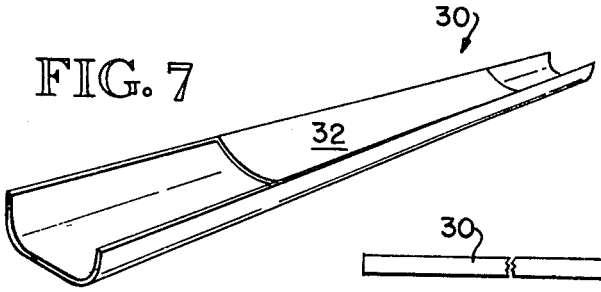
FIG. 7 is an isometric view of a splint adapted for use with the present driving means.

FIG. 7 shows the preferred configuration of the splint, although the present invention is not intended to be limited to this particular configuration. It is to be noted that the splint has a fairly large concave inner surface 32 which is adapted to be in contact with and give a large surface support to the pole to be splinted. The ends of the inner surface 32 of splint 30 are left relatively open to allow the tool to be easily inserted and retracted and the outer portion 34 of the splint is curved to give a pleasing appearance and the maximum strength for the amount of material involved.

Figure 8:
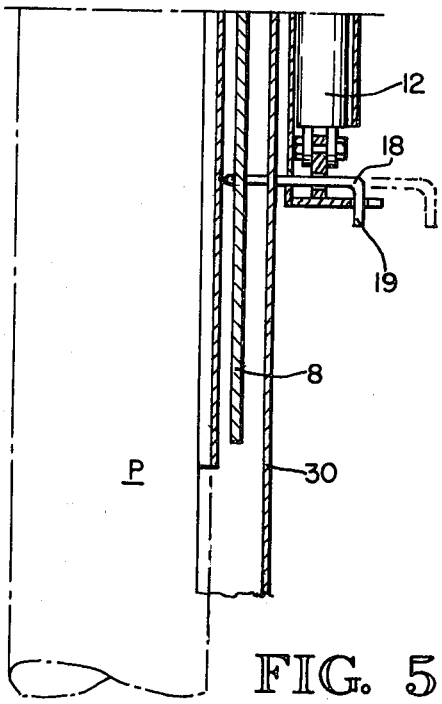
FIG. 8 is an enlarged view of the outboard end of the boom which is used for driving splints and showing the attachment of one stabilizing means.
Figure 9:
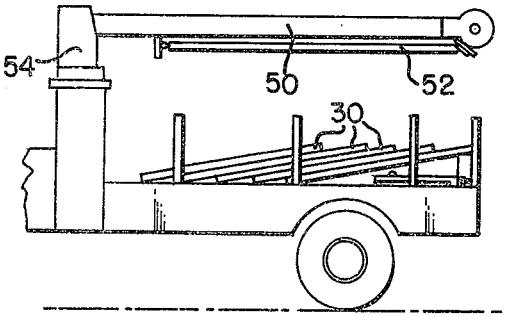
FIG. 9 is an environmental view showing the relative elements of the boom mechanism as mounted upon the truck which would also carry splints.
Figure 10:
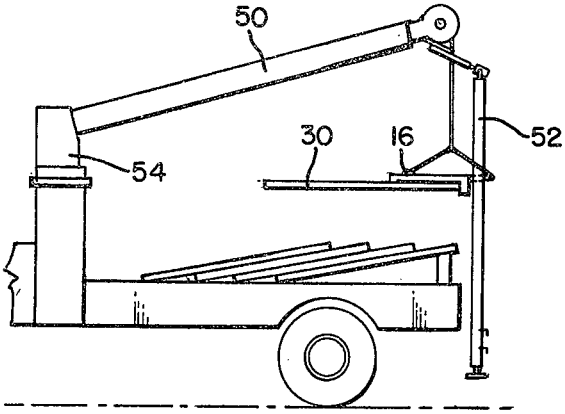
FIG. 10 shows the boom with a splint attached and the deadleg dropped to a relatively usable position.

FIG. 8 will now be described in conjunction with FIGS. 9 through 13 which sequentially show the steps of moving a splint from the truck to the position adjacent a standing pole for insertion into the ground thereby. As can be seen in FIG. 9, the truck is in travel condition with a boom 50 in an approximately horizontal condition generally parallel to the framework of the vehicle. Secured to the underside of the boom is a deadleg 52 for purposes to be hereinafter described. The boom 50 would normally be mounted upon a turntable shown schematically as 54 and which would include a winch and the controls. As can be seen in FIG. 12 the truck would also include an operator's station adjacent the turntable allowing complete control of the boom. The truck would normally have a flatbed storage area whereat a plurality of splints 30 may be carried. As seen in FIG. 12 the deadleg 52 has been moved to a position appropriate for use and the driving tool has been secured to the cable trained over the outer pulley boom 50. The driving head has been placed within a splint 30 and the splint lifted for movement to proper position.

Figure 11:
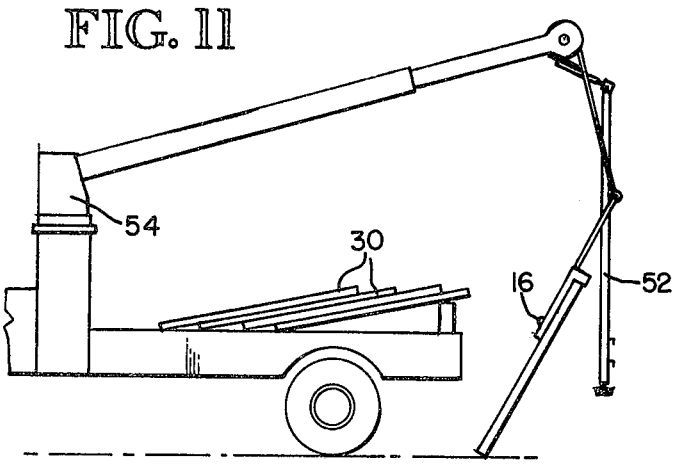
FIG. 11 shows the splint being raised to position with the deadleg in proper position for disposal against the supporting ground.
Figure 12:
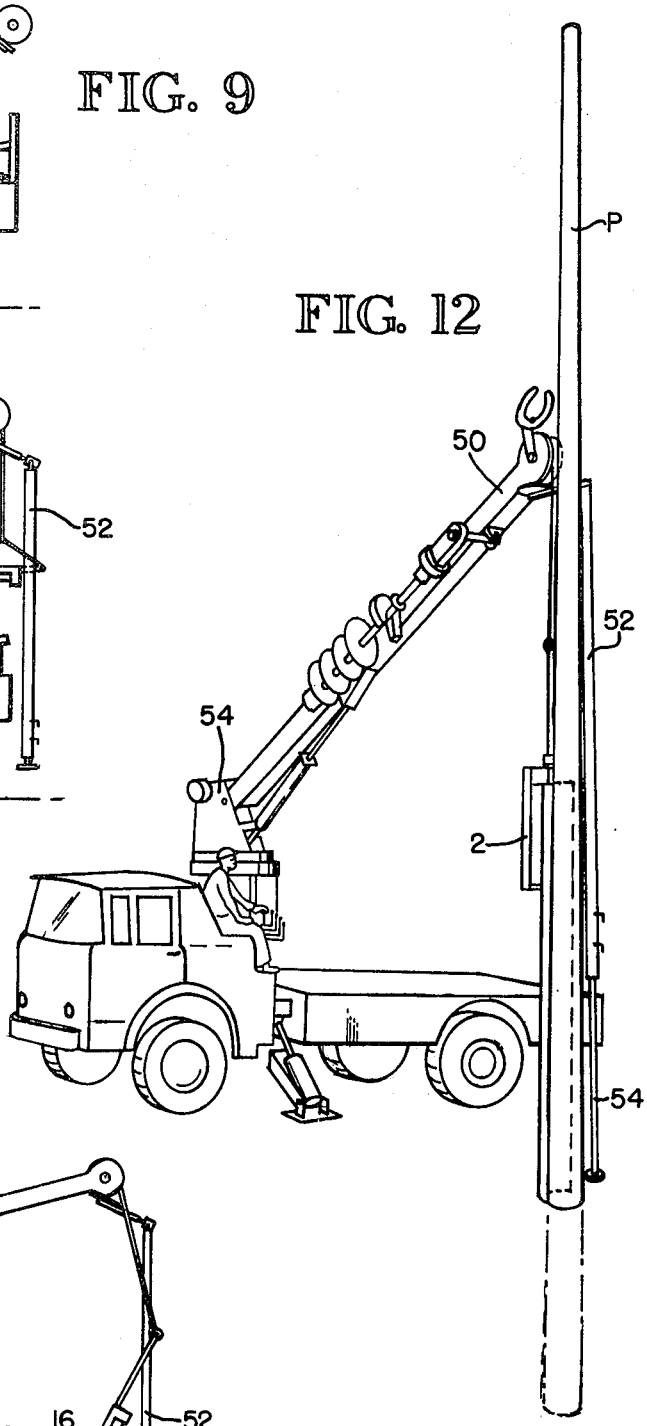
FIG. 12 is an environmental view showing the splint deadleg and boom in position adjacent a vertical wooden pole to be reinforced.

In FIG. 11 the boom has been extended to move the splint to a position adjacent the pole and the cable has been released from eye 16 to allow the splint to be swung to a vertical position. When the splint is appropriately placed, the deadleg 52 will be extended with its lower portion 54 such that it contacts the ground and provides a rigid support for the boom 50 during the driving operation. As can be seen, the driving tool 2 is hung by a capable and has appropriate interconnection such that it will continuously raise and drop the hammer until the splint is properly driven to the ground.

Following driving, the splint is then strapped to the pole by means well known in the art and forms a permanent and rigid reinforcement.

Referring back now to FIG. 8 the outer end of the boom 50 is shown and it includes a pulley 60 to guide the cable or other flexible means for supporting the driving tool during operation. Welded to the bottom portion of the boom 50 is a plate 62 having an arm 64 pivotally secured thereto. The arm 64 is pivotally secured to plate 62 that they may be moved to either side of the cable or flexible means as is appropriate. The plate 62 permits arm 64 to be placed at any appropriate angle and still give rigid support against downward movement at the boom, since it is secured to plate 62 at one point and contacts the plate at a second point. The outboard end of arm 64 has an extension 66 at its outer end which is tapered to an appropriate size to fit within a cap 68. Cap 68 is mounted to the outer end of 66 and has pivotally depending therefrom the deadleg 52. As will readily be seen the connection between 52 and the boom 50 when properly secured is rigid and when the lower portion 54 of deadleg 52 is placed in contact with the ground the boom itself is a relatively stable apparatus and serves as a base for driving the splint into proper position.

As an alternative support for boom 50, a clamp rigidly secured to the boom may be caused to interact with the pole itself preventing vertical movement of the boom. This means of stabilization is possible because the weakness of the pole is not relative to vertical movement but relative to horizontal movement.

Figure 13:
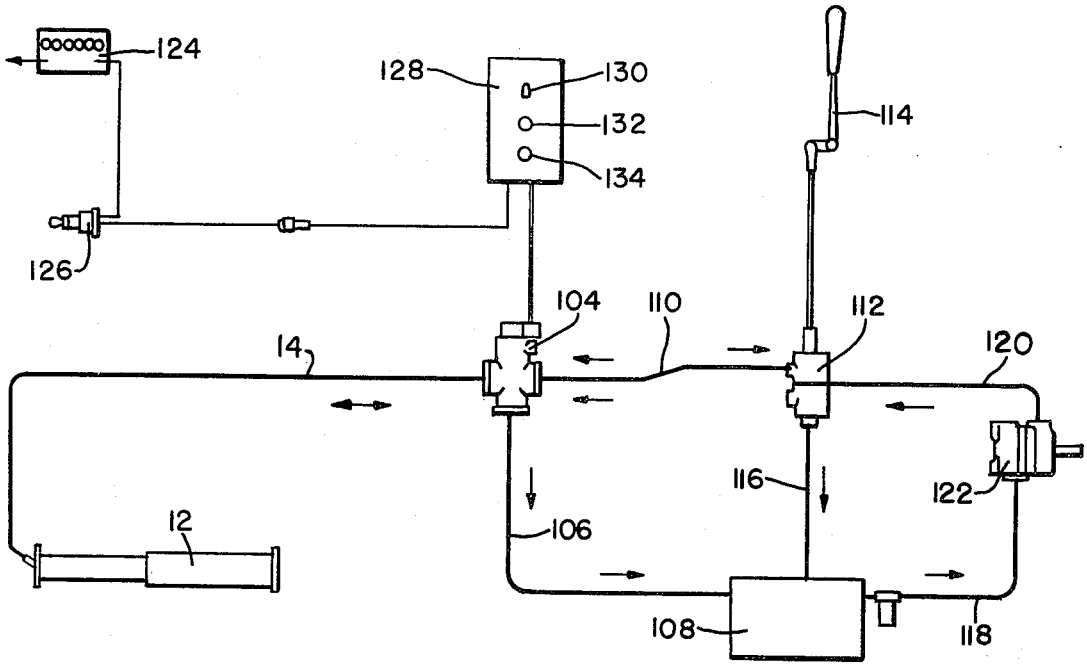
FIG. 13 is a schematic of the preferred hydraulic system for the present invention.

Referring now to FIG. 13, the preferred hydraulic circuit for control of the stub or splint driving system is shown. Located in the lower left-hand corner of the diagram is a schematic representation of the hammer lift cylinder 12. Mounted for fluid communication with the hammer lift cylinder 12 is the conduit 14 capable of handling 33 gallons per minute and is interconnected with a solenoid-operated dump valve 104. The lower conduit 106 from the dump valve 104 leads directly to the hydraulic oil reservoir or sump 108. A second conduit 110 leads from the dump valve 104 to a control valve 112 which has a manually actuated control lever 114. From the control valve 112 a conduit 116 likewise leads to the sump 108 such that fluid will be circulated even if the valve is closed. Directly connected to the control valve 112 and the sump 108 by means of conduits 118 and 120 is a pump 122 to provide the pressure necessary for operation of the mechanism.

The hammer may be operated either manually by means of the control lever 114, as explained in greater detail hereinafter, or alternatively controlled by an automatic system which includes a source of power such as a battery 124 which is interconnected with the ignition switch 126 and then to an automatic control box 128 having a selective on-off switch 130 as well as two control knobs 132 and 134. The control knob 132 predetermines the length of time when the current is off. During the time the current is off the cylinder raises along the piston rod and weight is lifted to its uppermost position. The control knob 134 controls the length of time the current is on. During the time when the current is on the piston rod can extend and the weight falls. Thus, it can be seen that if the automatic control box is placed into operation, the hammer will be automatically lifted and dropped at a predetermined timed sequence controlled by the knobs 132 and 134. However, if it is desirable to manually control the hammer, the automatic control box will not be engaged and the lever 114 will be used to raise and drop the hammer.

Figure 14:
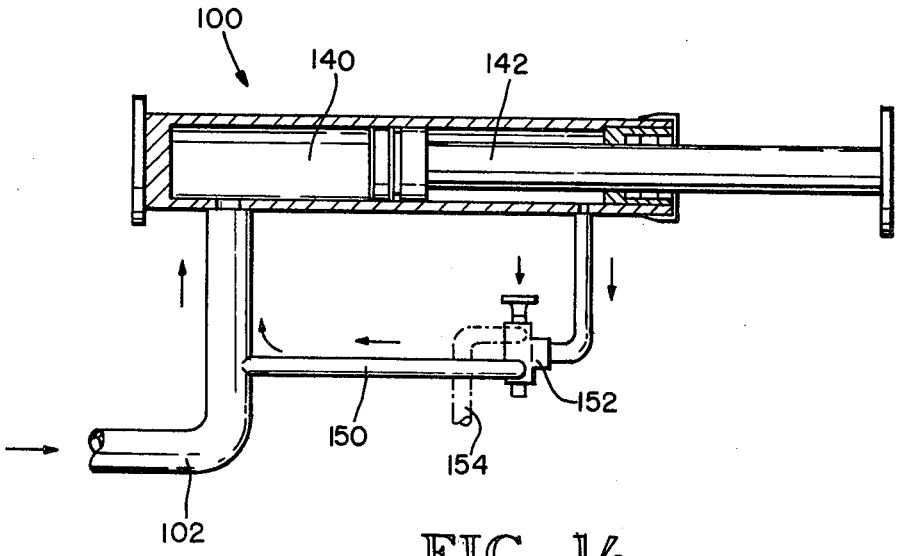
FIG. 14 is an enlarged schematic of a dual range hydraulic system.

Referring now to FIG. 14, a modified, non-preferred dual range hammer lift system can be seen and includes the input conduit 102 which feeds directly into the cylinder 140 forcing the outer cylindrical shell its attached hammer to move upwardly relative to the splint. In addition to the conduit 102 a secondary conduit 150 interconnects conduit 102 with the enclosed area behind the ram allowing communication therewith. In the event that the selector valve 152 is in its lowered or pushed down position, fluid can pass through conduit 150 to the back side of the piston rod 142 and the cylinder will generate 18,000 pounds force. Alternatively to the above, the selector valve 152 may be pulled up, directing any fluid behind the piston rod 142 to the sump or reservoir via conduit 154 and then the cylinder will generate 24,000 pounds of force. The difference in force generated is only illustrative and caused by the fluid pressure behind the piston rod. The actual forces will depend both upon the pressure within the main conduit 102 and the relative surface areas on opposite sides of the ram subjected to the pressure.

As can be seen, the hereinabove described tool and method allows a pole to be rapidly and inexpensively splinted since the entire operation involves only one vehicle and the vehicle, as shown in FIG. 11, can include a plurality of other mechanisms. The driving tool itself is of a small enough size that it can be appropriately carried along with a plurality of splints while the vehicle is doing other operations and upon the noticing of a pole which needs to be splinted the vehicle need only stop for a short time, have the tool interconnected with the boom, have a splint placed upon the driving tool, move to proper position by the control of the boom and, if necessary have connected the deadleg or clamp, then driven to the appropriate depth. Following the driving as explained hereinabove the splint is wrapped to the pole to provide a rigid securement.

The embodiments of the invention in which an exclusive property or privilege is claimed are defined as follows:

1. The method of installing pole splints comprising the steps:

providing a splint driving mechanism movable between supply and driving locations, engaging the splint at the supply location by securing the splint to the driving mechanism, moving the driving mechanism with splint attached to the driving location, unsecuring the splint from the driving means at the driving location, and driving the splint into the ground with the driving mechanism.

2. The method of claim 1, said splint having a hollow interior, said driving mechanism having an elongated tongue, said step of engaging the splint including inserting the tongue into the splint interior and latching the tongue to the splint, said step of unsecuring the splint from the driving mechanism including unlatching the tongue and splint but maintaining the tongue within the splint for guidance while driving.

3. The method of claim 1, said splints lying generally horizontally at said supply location, said step of engaging the splint at the supply location including supporting the splint driving mechanism in a generally horizontal and balanced condition to easily position the driving mechanism into engagement with a splint at the supply location and subsequently supporting the splint driving mechanism and attached splint generally vertically at the driving location.

4. The method of claim 2, said splints lying generally horizontally at said supply location, said step of engaging the splint at the supply location including supporting the splint driving mechanism in a generally horizontal and balanced condition to easily position the driving mechanism into engagement with a splint at the supply location and subsequently supporting the splint driving mechanism and attached splint generally vertically at the driving location.

* * * * *